US005212339A

United States Patent [19]

Piltch

[11] Patent Number: 5,212,339

[45] Date of Patent: May 18, 1993

[54] EXPLOSIVE LASER LIGHT INITIATION OF PROPELLANTS

[75] Inventor: Martin S. Piltch, Los Alamos, N. Mex.

[73] Assignee: The United States of America as represented by the United States Department of Energy, Washington, D.C.

[21] Appl. No.: 858,457

[22] Filed: Mar. 27, 1992

[51] Int. Cl.[5] ..... F42B 3/113

[52] U.S. Cl. ..... 102/202; 102/201; 60/39.823; 60/256

[58] Field of Search ..... 102/202, 201; 60/39.821, 39.823, 256, 39.06

[56] References Cited

U.S. PATENT DOCUMENTS

| | | | |
|---|---|---|---|
| 3,362,329 | 1/1968 | Epstein | 102/201 |
| 3,618,526 | 11/1971 | Baker | 102/201 |
| 4,738,100 | 4/1988 | Koovey | 102/202 |
| 5,052,011 | 9/1991 | Piltch et al. | 372/77 |
| 5,081,900 | 1/1992 | Buntzen et al. | 102/201 |

*Primary Examiner*—Stephen M. Johnson

*Attorney, Agent, or Firm*—Milton D. Wyrick; Paul D. Gaetjens; William R. Moser

[57] ABSTRACT

A improved initiator for artillery shell using an explosively generated laser light to uniformly initiate the propellent. A small quantity of a high explosive, when detonated, creates a high pressure and temperature, causing the surrounding noble gas to fluoresce. This fluorescence is directed into a lasing material, which lases, and directs laser light into a cavity in the propellant, uniformly initiating the propellant.

7 Claims, 1 Drawing Sheet

EXPLOSIVE LASER LIGHT INITIATION OF PROPELLANTS

The invention is a result of a contract with the Department of Energy (Contract No. W-7405-ENG-36).

BACKGROUND OF THE INVENTION

The present invention generally relates to the initiation of propellants in artillery shells, and, more specifically, relates to the use of laser light generated with explosives to initiate these propellants.

Conventional artillery shells have a propellent powder for accelerating the projectile. Currently, the propellant is initiated by a percussion primer and flame tube. This method of initiation produces high peak pressures inside the shell cartridge, and a shock wave which travels within the cartridge. This shock wave is responsible for increasing the peak pressures to which the cartridge and gun barrel are subjected, pressures which are well beyond the value required to produce the desired muzzle velocity.

If these peak pressures can be avoided, several advantages can be realized. For one, the cartridge and gun barrel, which are currently designed to withstand higher than required peak pressures, would be reduced in mass and/or strength, with the concomitant decrease in weight. For another, the use of initiators which do not produce these high peak pressures in an existing weapon, results in improvement in the range and precision of the round.

Recent work has indicated that conventional propellants can be initiated by laser light. Laser light at various wavelengths and fluences has proven capable of uniformly initiating propellants, a tremendous improvement over the conventional method.

It is therefore an object of the present invention to provide apparatus for initiating the propellant in an artillery shell which does not produce high peak pressures or shock waves.

It is another object of the present invention to initiate the propellant in artillery shells using laser light.

It is a feature of the present invention that artillery shell cartridges and gun barrels can be made lighter.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus of this invention comprises an artillery shell with improved initiation comprising a casing having proximal and distal ends and a detonation well in the proximal end, with a projectile fixed to the distal end of the casing. Propellant means are inside the casing for launching the projectile toward a target, with the propellant means defining first and second axial cavities. A transparent window separates the first axial cavity from the second axial cavity, and a high explosive material is packed into the proximal end of the casing inside the first axial cavity and adjacent to the detonation well for producing high pressure within the first axial cavity. A fluorescing gas is confined in the first axial cavity for producing light and heat in response to the high pressure produced by the high explosive. A lasing material having proximal and distal ends is mounted coaxially within the first axial cavity, the lasing material having a total reflector attached to its proximal end, and a partial reflector attached to its distal end, wherein the distal end with the partial reflector is secured to the transparent window. Reflector means surround the lasing material for concentrating light and heat from the fluorescing gas into the lasing material, whereby laser light produced by the lasing material is directed into the second axial cavity for uniformly initiating the propellant.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION

Figure 1:
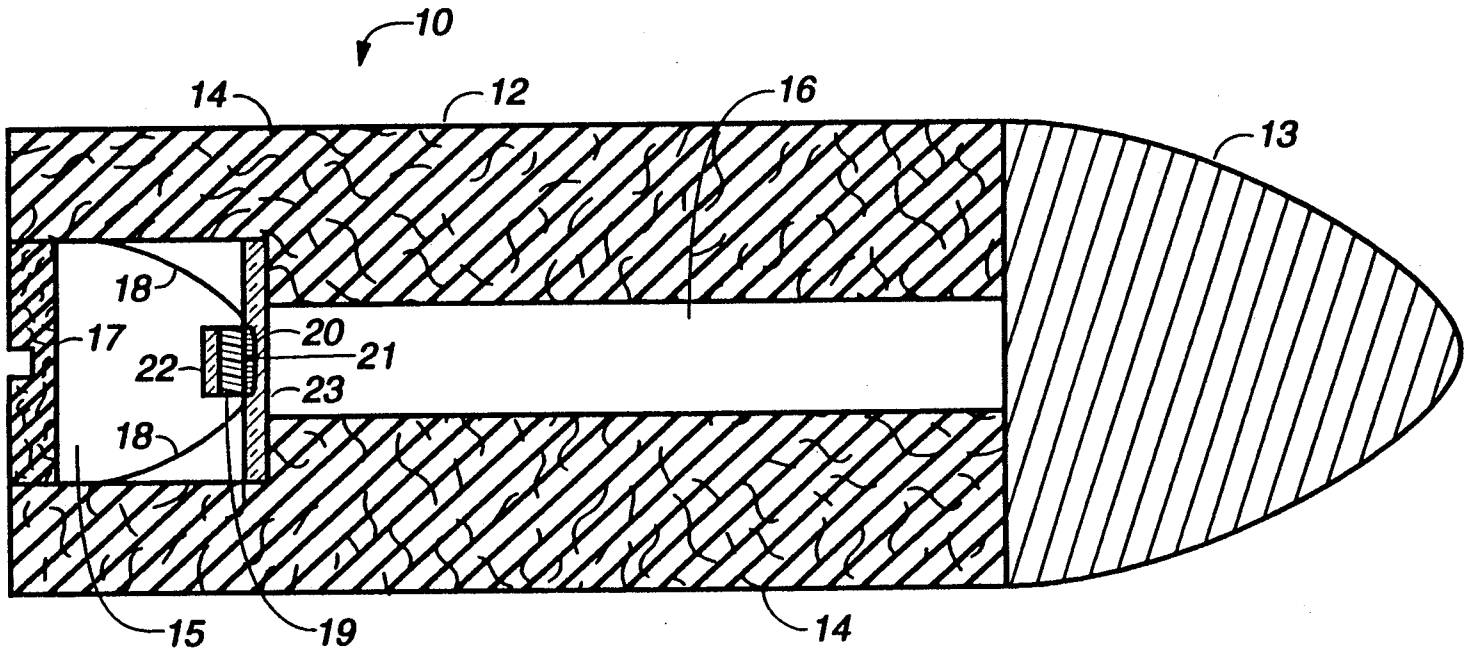
FIG. 1 is a schematical cross-sectional side view of an artillery shell with an enclosed laser initiator according to the present invention.

The present invention uses explosively generated laser light to initiate the propellant in artillery shells. Initiation by laser light greatly reduces the maximum pressure and shock wave experienced by shell cartridges and gun barrels. The production of laser light by explosives is taught in U.S. Pat. No. 5,052,011, issued Sep. 24, 1991, to Piltch et al., the inventor herein. In that patent, the apparatus was a device which used the laser light as a weapon. In the present invention, the laser light is used to initiate a propellant which in turn, launches a projectile.

The invention is best understood by reference to FIG. 1. Here, a schematical cross-sectional view of an artillery shell 10 is illustrated. Artillery shell 10 has casing 12 with projectile 13 attached. Inside casing 12, propellant 14 occupies most of the space, except for axial cavities 15, 16, which are separated by transparent window 23. Axial cavity 15 contains high explosive 17, which is a small disc of high explosive, conical reflector 18, and lasing material 19, as well as a small volume of a noble gas (not shown). Lasing material 19 has totally reflecting mirror 22 attached to its proximal surface, and partially reflecting mirror 21 attached to its distal surface. The noble gas can be most be most any primarily monatomic gas. For example, any one or more of the group consisting of Argon, Xenon, and Krypton would be satisfactory.

High explosive 17, is in the form of a small disk, and should be capable of providing chemical energy of approximately 5000 J/gm. It can be a small pellet of high explosive of approximately 1 gm in mass. Conical reflector 18 is a reflective surface which may be shaped into the form of a truncated conical section, capable of reflecting both heat and light with high efficiency. Conical reflector 18 may be comprised of aluminum, or other material suitable for the application. Lasing material 19 can be in the form of a rod of or disk with total reflector 22 attached. Lasing material 19 is mounted at the longitudinal axis of casing 12, inside recess 20 of transport window 23. Lasing material 19 is a visible wavelength dye laser utilizing an organic dye dissolved in small concentration within a polymeric host, and is referred to herein as a dye-doped plastic. Axial cavity 16, runs from axial cavity 15 to projectile 13, and is simply an axial cavity in propellant 14.

The basic principle of the present invention is that the energy released from high explosive 17 upon detonation produces adiabatic compression and subsequent heating of the small volume of a noble gas (not shown) which occupies axial cavity 15. The heating is produced by the supersonic detonation wave of approximately $v=7$ mm/$\mu$s produced by high explosive 17 as the detonation wave proceeds from high explosive 17 into the contiguous region of noble gas. This reaction produces a heated gas region in axial cavity 15 characterized by a black body temperature greater than 25,000K, and fluorescence.

The fluorescent radiation emanating from the heated noble gas, both heat and light, is collected by conical reflector 18 and reflected to lasing material 19, causing it to lase. The light from lasing material 19 enters axial cavity 16 where it is reflected from the surfaces of propellant 14, uniformly initiating burning in propellant 14. With sufficient burning of propellant 14, projectile 13 is launched from casing 12 toward its target. All of this is accomplished with only an inconsequential detonation wave being produced by the high explosive 17.

It is well known in the art that conventional propellants can be initiated by laser radiation of various wavelengths and fluences. By proper selection of the laser dye for lasing material 19, radiation of any visible wavelength can be produced in order to closely match the most suitable color for initiation of propellant 14. Typical fluences achieved with the current invention is more than 1 Joule/cm$^2$. This fluence is sufficient to initiate any modern propellant, according to measurements made at the Army Ballistic Research Laboratory, Aberdeen, Md. Propellants can be developed which are optimized for laser initiation. This optimization will reduce the fluence required for initiation and hence, the quantity of high explosive 17 required to excite lasing material 19.

The foregoing description of the preferred embodiments of the invention have been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An artillery shell with improved initiation comprising:

a casing having proximal and distal ends and a detonation well in said proximal end;

a projectile fixed to said distal end of said casing;

propellant means inside said casing for launching said projectile toward a target, said propellant means defining first and second axial cavities;

a transparent window having proximal and distal surfaces separating said first axial cavity from said second axial cavity, said proximal surface defining a recess;

a high explosive material packed into said proximal end of said casing inside said first axial cavity adjacent to said detonation well for producing high pressure and high temperature with in said first axial cavity;

a fluorescing gas confined in said first axial cavity for producing light and heat in response to said high pressure produced by said high explosive;

a lasing material having proximal and distal end mounted coaxially within said first axial cavity, said lasing material having a total reflector attached to its proximal end, and a partial reflector attached to its distal end, wherein said distal end with said partial reflector is secured in said recess in said proximal surface of said transparent window;

reflector means surrounding said lasing material for concentrating light and heat from said fluorescing gas into said lasing material;

whereby laser light produced by said lasing material is directed into said second axial cavity for uniformly initiating said propellant means.

2. The artillery shell described in claim 1 wherein said reflector means comprises a truncated conical section.

3. The artillery shell described in claim 2 wherein said truncated conical section comprises aluminum.

4. The artillery shell described in claim 1 wherein said lasing material comprises a rod of lasing material.

5. The artillery shell described in claim 1 wherein said lasing material comprises a disk of lasing material.

6. The artillery shell described in claim 1 wherein said lasing material comprises a dye-doped plastic.

7. The artillery shell described in claim 1 wherein said fluorescing gas is one or more of the group consisting of Argon, Xenon, or Krypton.

* * * * *